US008766889B2

(12) United States Patent
Lai et al.

(10) Patent No.: US 8,766,889 B2
(45) Date of Patent: Jul. 1, 2014

(54) LIQUID CRYSTAL DISPLAY AND DRIVING METHOD THEREOF

(75) Inventors: Ming-Sheng Lai, Hsin-Chu (TW); Chih-Wei Wang, Hsin-Chu (TW); Hsueh-Ying Huang, Hsin-Chu (TW); Chen-Kuo Yang, Hsin-Chu (TW)

(73) Assignee: Au Optronics Corporation, Hsin-Chu (TW)

( * ) Notice: Subject to any disclaimer, the term of this patent is extended or adjusted under 35 U.S.C. 154(b) by 1774 days.

(21) Appl. No.: 12/056,355

(22) Filed: Mar. 27, 2008

(65) Prior Publication Data

US 2009/0027320 A1 Jan. 29, 2009

(30) Foreign Application Priority Data

Jul. 26, 2007 (TW) ..... 96127335 A

(51) Int. Cl.
*G09G 3/36* (2006.01)

(52) U.S. Cl.
USPC ..... 345/87; 345/88; 345/89; 345/90; 345/91; 345/92; 345/93; 345/94; 345/95; 345/96; 345/97; 345/98; 345/99; 345/100; 345/101; 345/102; 345/103; 345/104

(58) Field of Classification Search
USPC ..... 345/87
See application file for complete search history.

(56) References Cited

U.S. PATENT DOCUMENTS 5,818,407 A 10/1998 Hori et al.
5,835,170 A 11/1998 Fujiwara et al.
6,914,588 B2 * 7/2005 Tsai ..... 345/92
6,922,183 B2 * 7/2005 Ting et al. ..... 345/87
7,839,356 B2 * 11/2010 Hagood et al. ..... 345/55
7,864,150 B2 * 1/2011 Shih ..... 345/94
2007/0013643 A1 * 1/2007 Hong et al. ..... 345/100
2007/0018927 A1 * 1/2007 Kim ..... 345/92

FOREIGN PATENT DOCUMENTS

CN 1979311 A 6/2007
JP 7-311390 A 11/1995
TW 554324 9/2003

* cited by examiner

*Primary Examiner* — Alexander S Beck
*Assistant Examiner* — Jeffrey Steinberg
(74) *Attorney, Agent, or Firm* — Ming Chow; Sinorica, LLC

(57) ABSTRACT

A liquid crystal display and a driving method thereof are provided. The liquid crystal display includes a plurality of pixels, a plurality of scan lines, and a plurality of data lines. Each pixel includes a plurality of sub-pixels. Each sub-pixel is coupled to the data line, and includes a switch, a storage capacitor, and a sub-pixel electrode. The switch is coupled to a scan line to receive a scan signal. The switch is turned on by the scan signal to receive a data signal transmitted from the data line. The storage capacitors of the sub-pixels of each pixel are coupled to the scan lines, or the storage capacitor of one of the sub-pixels of each pixel is coupled to a common electrode and the storage capacitors of the other sub-pixels are coupled to the scan lines. The switch and the storage capacitor of each sub-pixel are coupled to different scan lines. The method includes transmitting the scan signal having a plurality of voltage levels to modulate the voltage levels of one or more sub-pixel electrodes of the sub-pixels of the same pixel, thereby enabling the sub-pixels of the same pixel to have different voltage levels.

4 Claims, 11 Drawing Sheets

LIQUID CRYSTAL DISPLAY AND DRIVING METHOD THEREOF

FIELD OF THE INVENTION

The present invention relates generally to a display, and particularly to a liquid crystal display and a driving method thereof.

BACKGROUND OF THE INVENTION

Owing to its superiority in resolution, weight, thickness and power consumption over a tradition cathode ray tube (CRT) display, a liquid crystal displays (LCD) is gradually replacing the traditional CRT display. In addition, the LCD technology progresses rapidly and the applications of electronic products expand continuously, thereby the applications of the LCD become increasingly extensive.

The picture of an LCD includes a plurality of pixels, and each of which pixels contains liquid crystals with a certain area for displaying images. Because liquid crystals will deflect under the influence of electric field and hence change transmission rate of light, when the LCD displays images, voltages will be applied to the pixels for producing electric field to the liquid crystals in the pixel areas. Thereby, the deflection angles of the liquid crystals in the pixel areas can be controlled. As a result, the transmission rate of light can be controlled, and the luminance of the pixels can be controlled accordingly. However, because the liquid crystals in each of the pixel are as deflect to a single deflection angle under the control of a single electric potential, when viewing pictures at different viewing angles, color and luminance distortion will occur owing to different angles between the line of sight and the liquid crystals. This phenomenon is called color washout. This phenomenon will make colors of images viewed at large viewing angles different from those viewed at the right angle. Thereby, only within a certain viewing angle color images with normal luminance can be viewed. If viewing the pictures of an LCD beyond the certain viewing angle, color distorted pictures will be viewed owing to differences in luminance.

Accordingly, the present invention provides an LCD and a driving method thereof, which solve the problems of color and luminance distortion at different viewing angles on the LCD pictures. Thereby, the display performance of the LCD can be improved, and the problems described can be solved.

SUMMARY

An objective of the present invention is to provide a liquid crystal display and a driving method thereof. According to the present invention, the liquid crystals in each pixel area have a plurality of deflection angles such that when viewing pictures at any viewing angles, the summations of the angles between the line of sight and the liquid crystals with different deflection angles vary only slightly. Thereby, color washout phenomenon can be avoided. Hence, by increasing the viewing angle of a liquid crystal display, the displaying performance thereof can be improved.

The liquid crystal display according to the present invention includes a plurality of scan lines, a plurality of data lines, a plurality of pixels, a data driver, and a scan driver. The scan lines and data lines, which are used for transmitting scan signals and data signals, are arranged in rows and in columns, respectively, and cross each other. Each of the pixels according to the present invention has a plurality of sub-pixels. Each of the sub-pixels is electrically coupled with a switch, a storage capacitor, and a sub-pixel electrode. The switch is coupled to a scan line. In addition, the storage capacitors of the sub-pixels of each pixel are coupled to the scan lines, or the storage capacitor of one of the sub-pixels of each pixel is coupled to a common electrode and the storage capacitors of the other sub-pixels are coupled to the scan lines. The switch and the storage capacitor of each sub-pixel are coupled to different scan lines. The data driver is coupled to the data lines, and transmits data signals to the sub-pixels, respectively. The scan driver is coupled to the scan lines, transmits scan signals to the switches in each row of the sub-pixels, and thereby turns on the switches for receiving the data signals. A preferred driving method according to the present invention includes transmitting the scan signal having a plurality of voltage levels to the pixels in each row to modulate the voltage level of at least one sub-pixel electrode of the sub-pixels of the same pixel, thereby enabling the sub-pixels of the same pixel to have different voltage levels. Accordingly, the deflection angles of the liquid crystals in the same pixel area are different. Thus, the color washout phenomenon can be solved.

DETAILED DESCRIPTION

In order to make the structure and characteristics as well as the effectiveness of the present invention to be further understood and recognized, the detailed description of the present invention is provided as follows along with preferred embodiments and accompanying figures.

Figure 1:
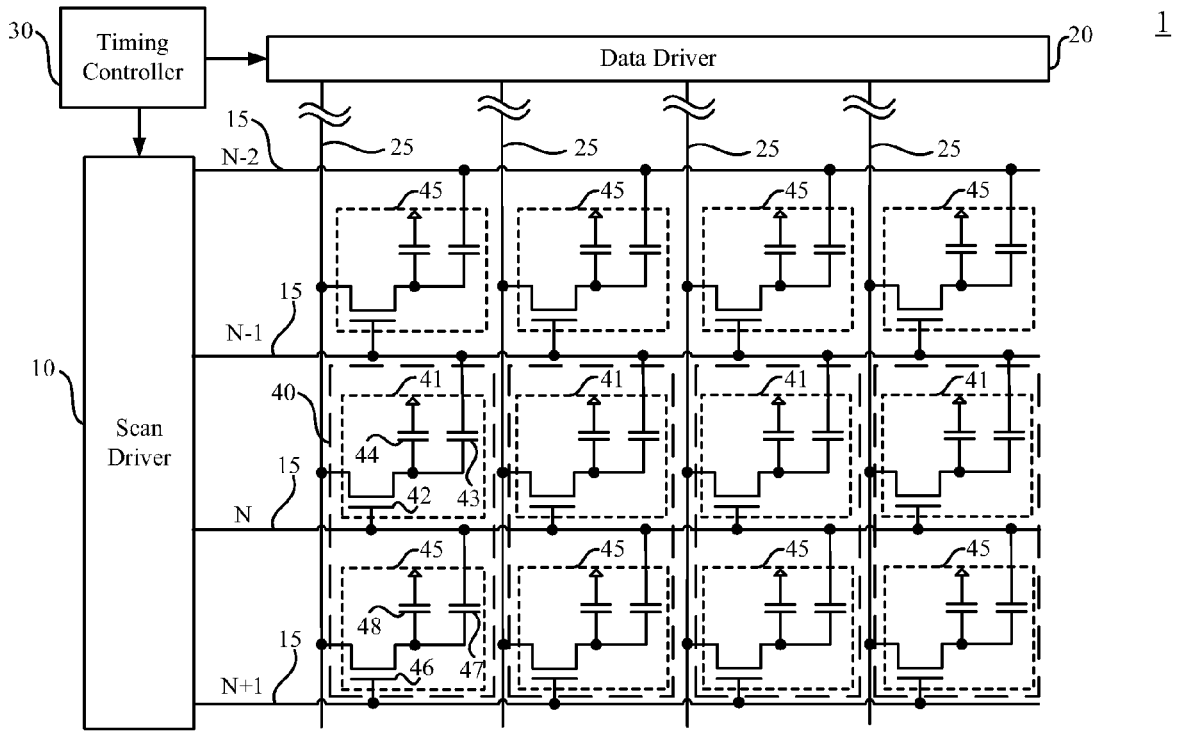
FIG. 1 shows a circuit diagram according to a preferred embodiment of the present invention.

FIG. 1 shows a circuit diagram according to a preferred embodiment of the present invention. As shown in the figure, a liquid crystal display (LCD) 1 includes a scan driver 10, a plurality of scan lines 15, a data driver 20, a plurality of data lines 25, a timing controller 30, and a plurality of pixels 40. The scan driver 10 is coupled to the scan lines 15 for transmitting scan signals, wherein the scan lines 15 $\{G_n\}$, n=1 2, . . . , N, . . . , are arranged in rows, N being a positive integer. The data driver 20 is coupled to the data lines 25 for transmitting data signals, wherein the data lines 25 $\{D_m\}$, m=1, 2, . . . , M, . . . , are arranged in columns, M being a positive integer, and cross the scan lines 15. The timing controller 30 is coupled to the scan driver 10 and the data driver 20, and is used for controlling the scan driver 10 and the data driver 20 for transmitting the scan signals and data signals.

The pixels 40 are arranged in matrix. Each of the pixels 40 has a plurality of sub-pixels. In the present preferred embodiment, the pixel 40 has a first sub-pixel 41 and a second sub-pixel 45. Switches 42, 46, storage capacitors 43, 47, and LCD capacitors 44, 48 are adapted in the first and the second sub-pixels 41, 45, respectively. The switches 42, 46 can be transistors with the gates thereof coupled to a scan line 15, respectively, for turning on the transistors by receiving the scan signals. Besides, the sources of the switches 42, 46 are coupled to a data line 25 for receiving the data signals when the transistors are turned on. The drain of the switch 42 and one terminal of the storage capacitor 43 are coupled to a sub-pixel electrode of the first sub-pixel 41, wherein the sub-pixel electrode is one terminal of the LCD capacitor 44. The other terminal of the storage capacitor 43 is coupled to the scan line 15 of the previous row. For example, the storage capacitor 43 of the first sub-pixel 45 of the scan line 15 on the N-th row is coupled to the scan line 15 on the (N−1)-th row, the switch 42 and the storage capacitor 43 of the first sub-pixel 41 are coupled to different scan lines 15 on the N-th and the (N−1)-th rows. Similar to the description above, the drain of the switch 46 of the second sub-pixel 45 and one terminal of the storage capacitor 47 are coupled to a sub-pixel electrode of the second sub-pixel 45, which means coupling electrically with the LCD capacitor 48. The other terminal of the storage capacitor 47 is coupled to the scan line 15 of the previous row. As shown in the figure, the storage capacitor 47 of the second sub-pixel 45 of the scan line 15 on the (N+1)-th row is coupled to the scan line 15 on the N-th row, the switch 46 and the storage capacitor 47 of the second sub-pixel 45 are coupled to different scan lines 15 on the (N+1)-th and the N-th rows.

According to the preferred embodiment of the present invention, each pixel 40 is divided into a plurality of sub-pixels 41, 45, and the storage capacitors 43, 47 of the sub-pixels 41, 45 are coupled to the corresponding scan lines 15 of the previous row, respectively. Namely, they are coupled to the scan lines 15 on the other rows, the switches 42, 46 and the storage capacitor 43, 47 of the sub-pixels 41, 45 are coupled to different scan lines 15. As shown in FIG. 1, the storage capacitor 43 of the scan line 15 on the N-th row is coupled to the scan line 15 on the (N−1)-th row. Thereby, the voltage level of the storage capacitors 43, 47 will be influenced by the driving signals of the corresponding scan lines 15 on the previous rows when the switches 42, 46 receive the scan signals, and hence the voltage levels of the sub-pixel electrodes of the sub-pixels will change. Consequently, the scan driver 10 according to the present invention modulates the voltage levels of the storage capacitors 43, 47 of the sub-pixels 41, 45 by transmitting scan signals with a plurality of voltage levels. Thereby, the voltage levels of the sub-pixel electrode of the sub-pixels 41, 45 are influenced to make the sub-pixels 41, 45 of the same pixel 40 have different voltage levels. Hence, the sub-pixels 41, 45 will produce different electric fields to act on the liquid crystals in the areas thereof. That is to say, the liquid crystals in the areas of the sub-pixel 41, 45 will deflect at different angles, so the liquid crystals in the area of the pixel 40 will deflect at different angles. Accordingly, when viewing the picture from any viewing angle, the color washout phenomenon will be avoided or be alleviated, and the displaying performance of LCDs will be improved.

Figure 2:
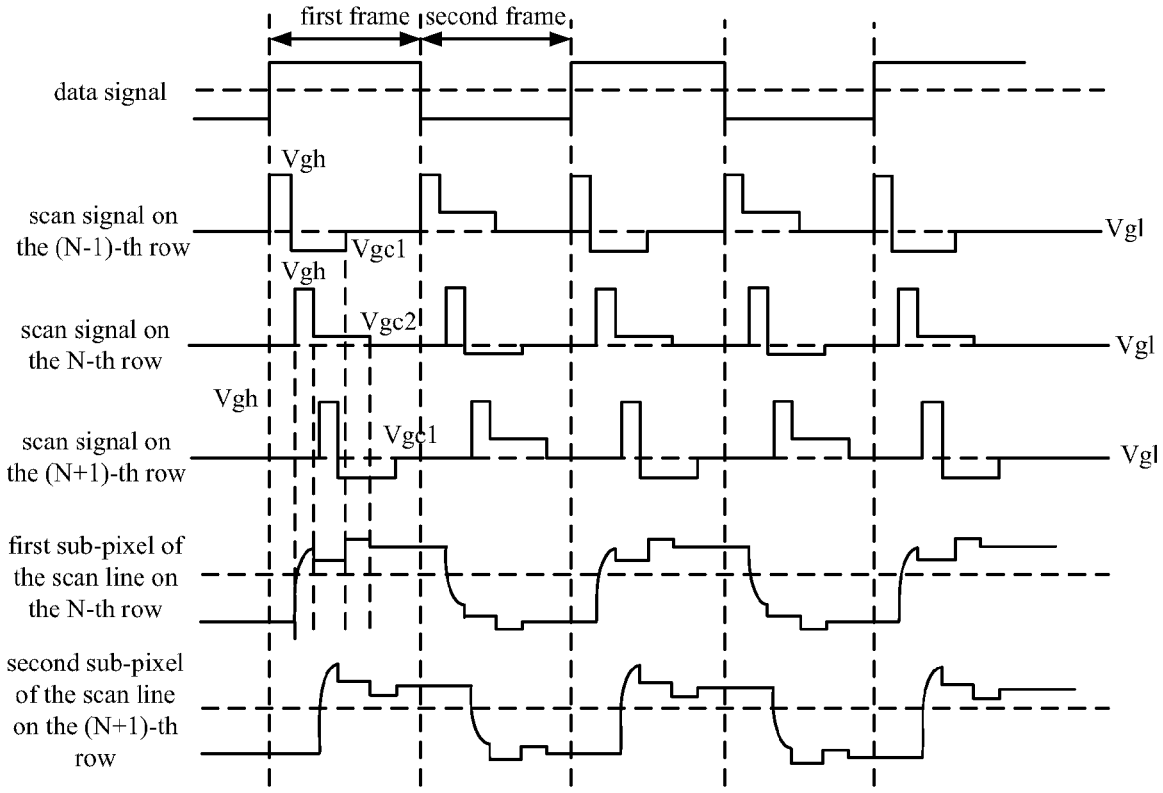
FIG. 2 shows the waveforms of the scan signals according to a preferred embodiment of the present invention.
Figure 3:
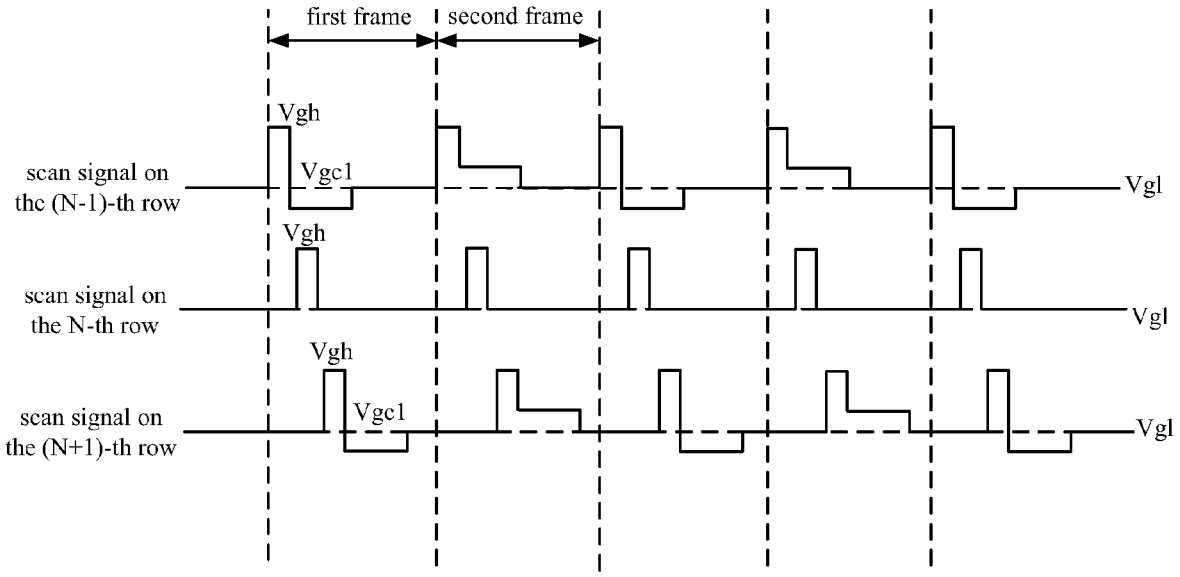
FIG. 3 shows other waveforms of the scan signals according to a preferred embodiment of the present invention.
Figure 4:
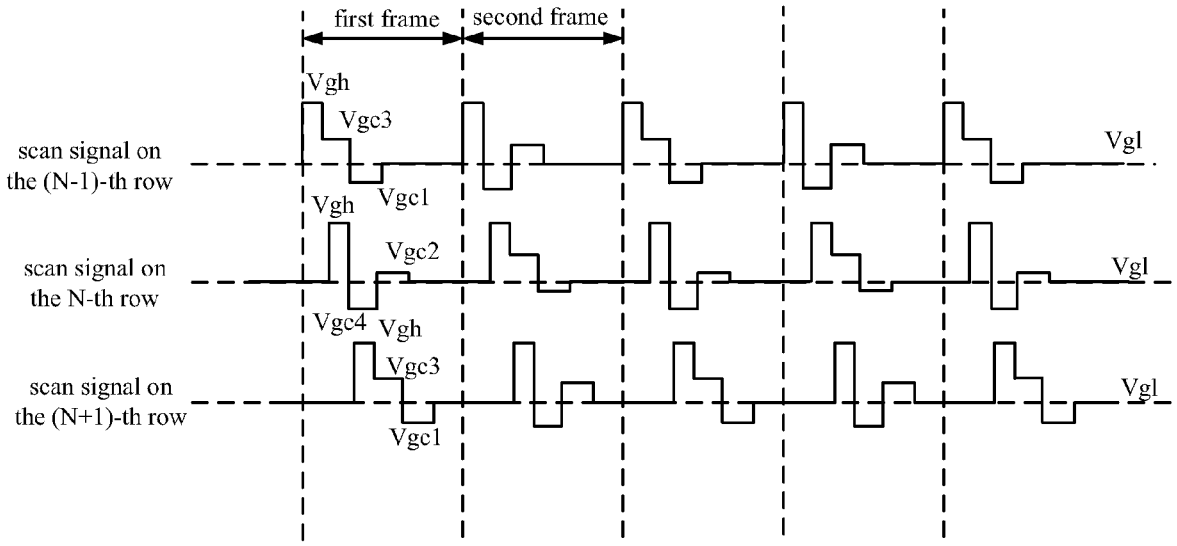
FIG. 4 shows other waveforms of the scan signals according to a preferred embodiment of the present invention.

FIG. 2 shows the waveforms of the scan signals according to a preferred embodiment of the present invention. As shown in the figure, the scan signal of the scan line 15 on the (N−1)-th row has three voltage levels, which are Vgh, Vgc1, and Vg1, respectively; the scan signal of the scan line 15 on the N-th row also has three voltage levels, which are Vgh, Vgc2, and Vg1, respectively. The scan signal of the scan line 15 on the (N+1)-th row is the same as the scan line signal of the scan line 15 on the (N−1)-th row. Likewise, the scan signal of the scan line 15 on the (N+2)-th row is the same as the scan line signal of the scan line 15 on the N-th row. Because the storage capacitor 43 of the first sub-pixel 41 of the scan line 15 on the N-th row is coupled to the scan line 15 on the (N−1)-th row, the voltage level of the first sub-pixel 41 will be influenced by the scan signal of the scan line 15 on the (N−1)-th row. When the voltage level of the scan signal received by the switch 42 of the first sub-pixel 41 is raised from Vg1 to Vgh, the storage capacitor 43 starts to charge, and thereby the voltage level of the first sub-pixel is raised accordingly.

When the voltage level is lowered from Vgh to Vgc2, the voltage of the storage capacitor 43 will be lowered, and hence the voltage level of the first sub-pixel 41 will be lowered accordingly and under the influence of the voltage level Vgc1 of the scan signal of the scan line 15 on the (N−1)-th row. Then, the voltage level of first sub-pixel 41 will be raised in accordance with the increase of the voltage level of the scan signal of the scan line 15 on the (N−1)-th row from Vgc1 to Vg1. Finally, the voltage level of first sub-pixel 41 will be lowered in accordance with the decrease of the voltage level of the scan signal of the scan line 15 on the N-th row from Vgc2 to Vg1. From the description above, the voltage difference of the first sub-pixel 41 of the scan line 15 on the N-th row is |Vgc1−Vg1|.

Likewise, the voltage level of the storage capacitor 47 of the second sub-pixel 45 of the scan line 15 on the (N+1)-th row is influenced by the scan signal of the scan line 15 on the N-th row. As shown in the figure, the voltage difference of the second sub-pixel 45 is |Vgc2|Vg1|. Because there is a difference between the scan signals of the scan line 15 on the (N−1)-th row and on the N-th row, there is a difference between the voltage levels of the scan lines 15 of the first sub-pixel 41 on the N-th row and of the second sub-pixel 45 on the (N+1)-th row. Thereby, the objective of the present invention is achieved. In addition, according to the present invention, the voltage difference of the first sub-pixel 41 is greater than that of the second sub-pixel 45, that is, |Vgc1|Vg1|>|Vgc2−Vg1|. Furthermore, owing to the characteristics of liquid crystals, the electric field acting on the liquid crystals at the same location needs to change its direction, just like alternating currents, and thereby avoiding lifetime shortening of the liquid crystals. Therefore, the scan signals according to the present invention will invert in accordance with the change of frames. As shown in the figure, the scan signal of the scan line 15 on each row inverts while changing from a first frame to a second frame, just like alternating currents. FIGS. 3 to 6 show other waveforms of the scan signals according to a preferred embodiment of the present invention. The scan signal of the scan line 15 on the N-th row according to the preferred embodiment of FIG. 3 has two voltage levels including Vgh and Vg1. As shown in the figure, the voltage difference of the second sub-pixel 45 of the scan line 15 on the (N+1)-th row is 0, while the voltage difference of the first sub-pixel 41 of the scan line 15 on the N-th row is still |Vgc1−Vg1|. Hence, the voltage difference of the first sub-pixel 41 is greater than that of the second sub-pixel 45. The scan signals according to the preferred embodiment in FIG. 4 have four voltage levels. The voltage levels of the scan line 15 on the (N−1)-th row are Vgh, Vgc1, Vgc3, and Vg1, while the voltage levels of the scan line 15 on the N-th row are Vgh, Vgc2, Vgc4, and Vg1. The voltage difference of the scan line 15 of the first sub-pixel 41 on the N-th row is |Vgc1−Vg1|, while the voltage difference of the scan line 15 of the second sub-pixel 45 on the (N+1)-th row is |Vgc2−Vg1|, where |Vgc1−Vg1|>|Vgc2−Vg1|.

Figure 5:
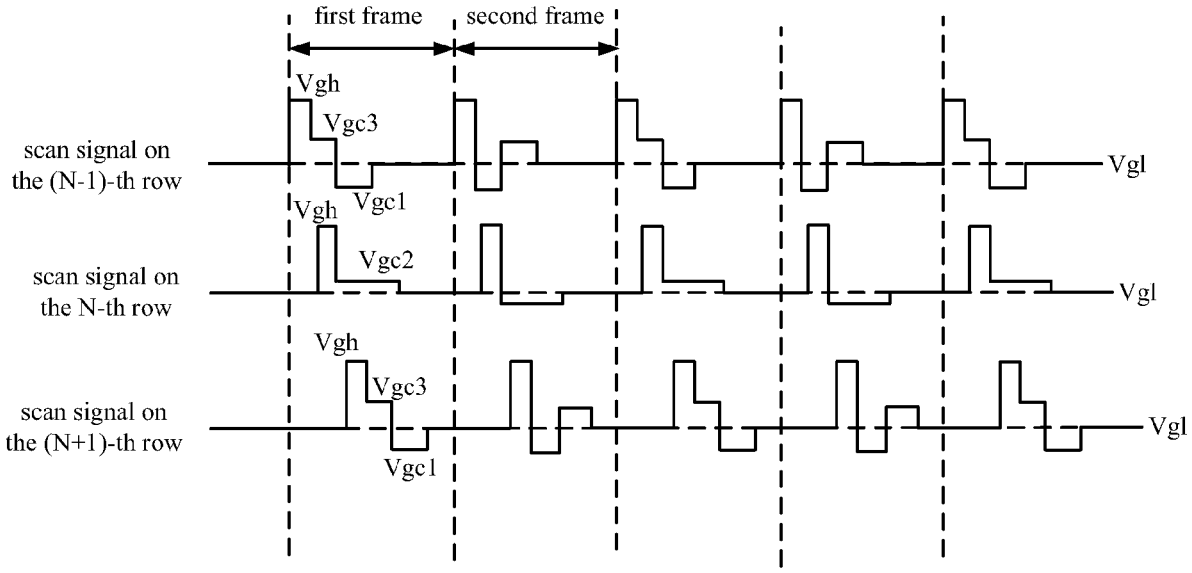
FIG. 5 shows other waveforms of the scan signals according to a preferred embodiment of the present invention.
Figure 6:
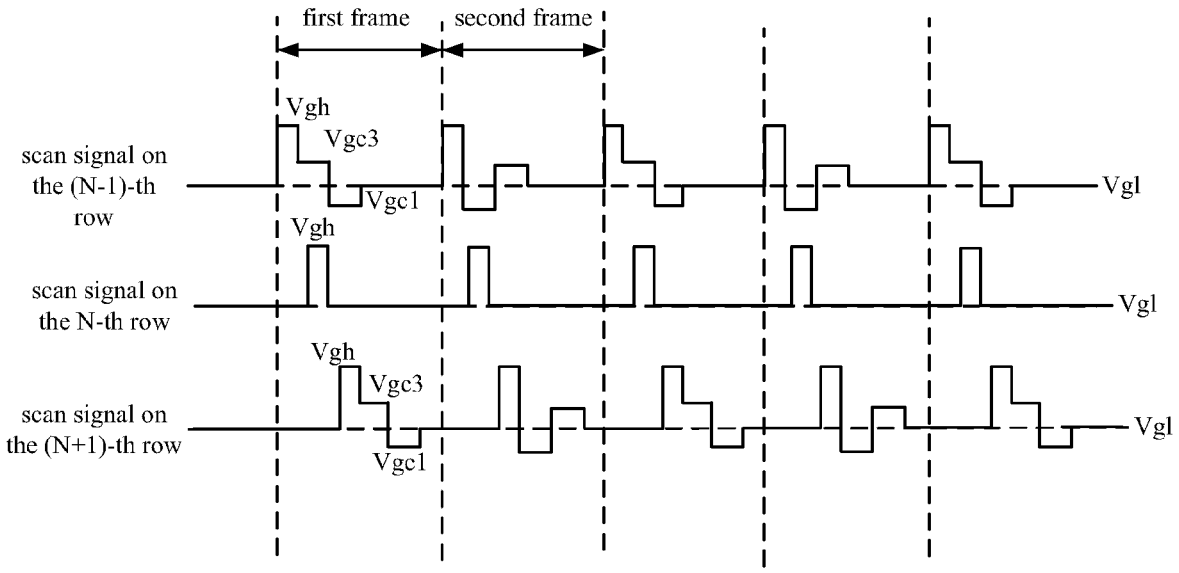
FIG. 6 shows other waveforms of the scan signals according to a preferred embodiment of the present invention.

The scan line signal of the scan line 15 on the N-th row according to the preferred embodiment of FIG. 5 has three voltage levels including Vgh, Vgc2, and Vg1. The voltage difference of the scan line 15 of the second sub-pixel 45 on the (N+1)-th row is |Vgc2−Vg1|, while the voltage difference of the scan line 15 of the first sub-pixel 41 on the N-th row is the same as the one in the previous preferred embodiment, where |Vgc1−Vg1|>|Vgc2−Vg1|. The scan line signal of the scan line 15 on the N-th row according to the preferred embodiment of FIG. 6 has two voltage levels including Vgh and Vg1. The voltage difference of the scan line 15 of the second sub-pixel 45 on the (N+1)-th row is 0, while the voltage difference of the scan line 15 of the first sub-pixel 41 on the N-th row is the same as the one in the previous preferred embodiment. Thereby, the voltage difference of the first sub-pixel 41 is greater than that of the second sub-pixel 45.

Figure 7:
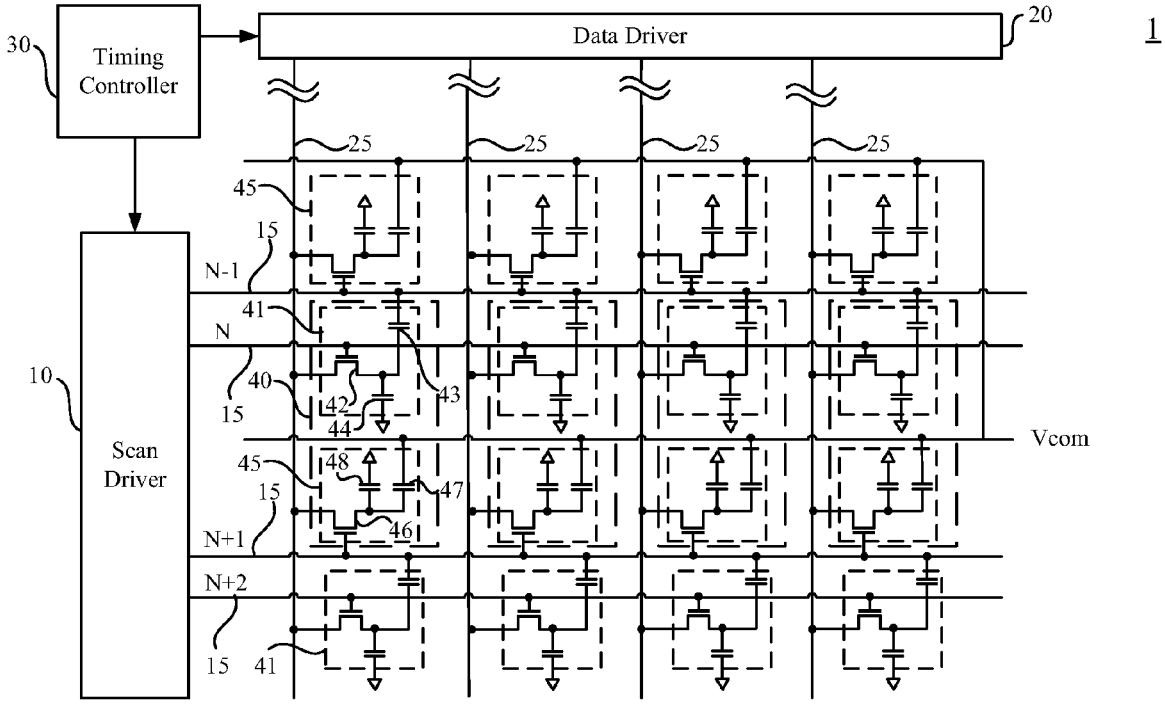
FIG. 7 shows another circuit diagram according to another preferred embodiment of the present invention.

FIG. 7 shows another circuit diagram according to another preferred embodiment of the present invention. As shown in the figure, the storage capacitor 47 of the second sub-pixel 45 according to the present invention is coupled to a common electrode Vcom, and thereby the voltage level of the second sub-pixel 45 will not be modulated. However, the voltage level of the first sub-pixel 41 will still be modulated by the scan signal of the scan line 15 on the previous row. Hence, there is still a difference between the voltage levels of the first and the second sub-pixels 41, 45. Consequently, the color washout phenomenon can be avoided by deflecting the liquid crystals in the areas of the sub-pixel 41, 45 of the pixel 40 at different angles. From the preferred embodiments of FIGS. 1 to 7, it is known that in addition to the two preferred embodiments described above, the storage capacitor 43 of the first sub-pixel 41 can be coupled to the scan line 15 on the next row, or the storage capacitors 43, 47 of the first and second sub-pixels 45, 47, respectively, can be coupled to the corresponding next scan lines 15. Alternatively, the storage capacitor 43 of the first sub-pixel 41 can be coupled to the scan line 15 on the previous row, while the storage capacitor 47 of the second sub-pixel 45 can be coupled to the scan line 15 on the next row, which means coupling to the scan line 15 on the other row. The switches 42, 46 and the storage capacitor 43, 47 of the sub-pixels 41, 45 are coupled to different scan lines 15.

Figure 8:
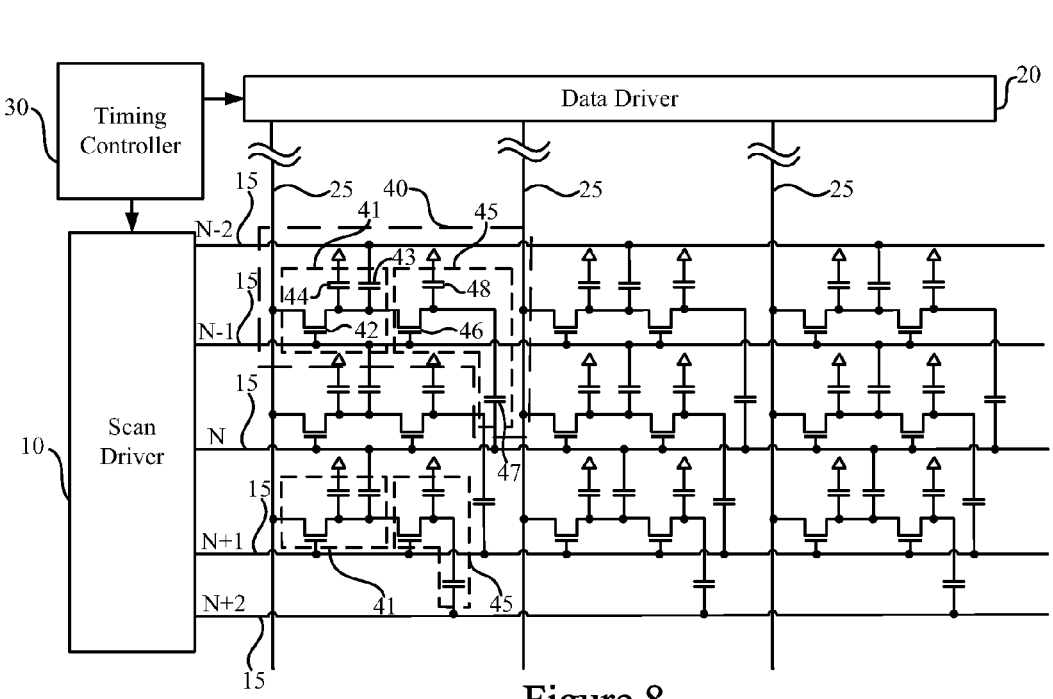
FIG. 8 shows another circuit diagram according to another preferred embodiment of the present invention.

FIG. 8 shows another circuit diagram according to another preferred embodiment of the present invention. As shown in the figure, the switches 42, 46 of the sub-pixels 41, 45 of each pixel 40 are coupled to the same scan line 15. Thereby, the number of scan lines can be decreased, and hence the cost can be reduced. Besides, the storage capacitor 43 of the first sub-pixel 41 is coupled to the scan line 15 on the previous row, while the storage capacitor 47 of the second sub-pixel 45 is coupled to the scan line 15 on the next row. Moreover, the switch 42 of the first sub-pixel 41 is coupled to the data line 25, while the switch 46 of the second sub-pixel 45 is coupled electrically to the switch 42. Thereby, the data signals will be transmitted to the switch 46 of the second sub-pixel 45 by way of the switch 42 of the first sub-pixel 41. That is, the switches 42, 46 are equivalently coupled to the same data line 25. From the description above, the voltage levels of the sub-pixels 41, 45 of the pixel 40 will be modulated by the scan signals of the scan lines 15 on the previous and next rows, respectively. Hence, there is a voltage difference between the sub-pixels 41, 45. Accordingly, the color washout phenomenon can be avoided.

Figure 9:
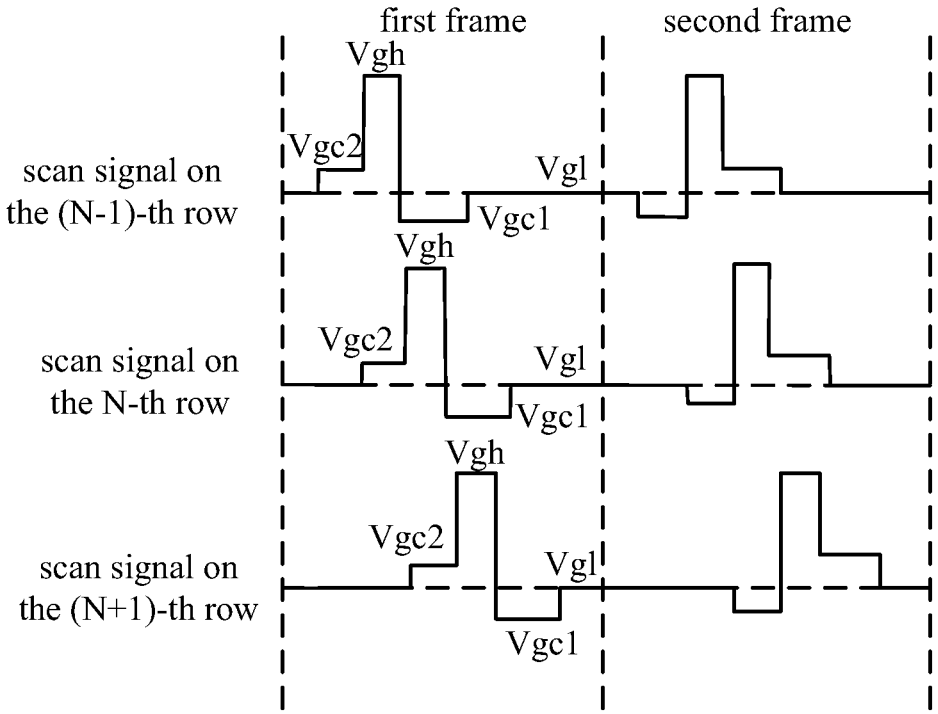
FIG. 9 shows other waveforms of the scan signals according to another preferred embodiment of the present invention.
Figure 10:
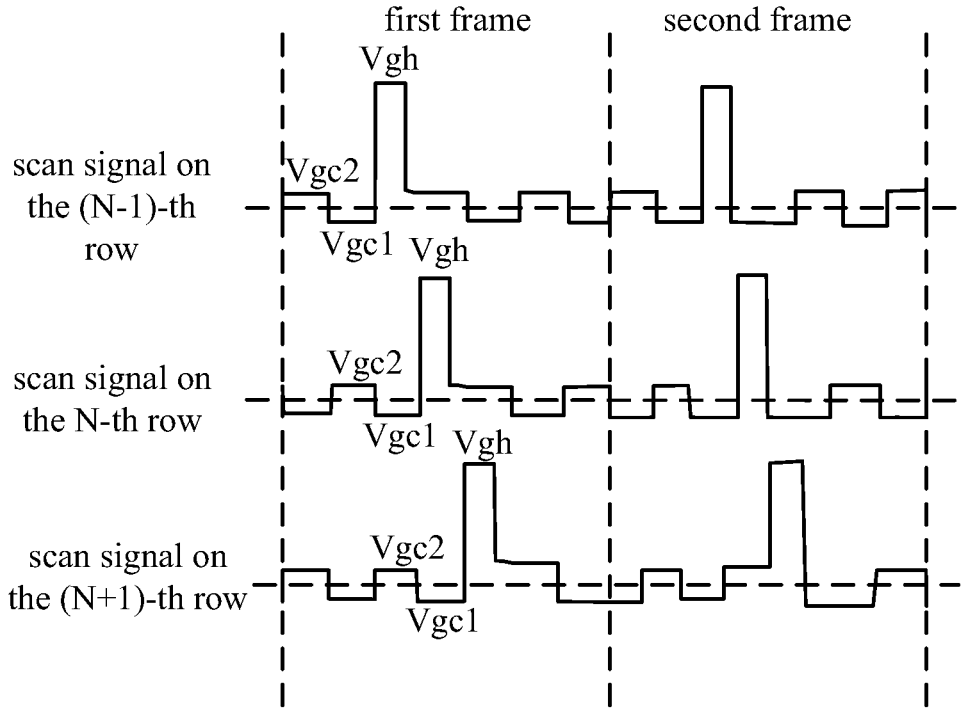
FIG. 10 shows other waveforms of the scan signals according to another preferred embodiment of the present invention.

FIG. 9 shows waveforms of the scan signals applied in the preferred embodiment of FIG. 8. As shown in FIG. 9, the scan signals have four voltage levels including Vgh, Vgc1, Vgc2, and Vg1. Taking the pixel 40 of the scan line 15 on the N-th row for example, when the voltage level of the scan signal of the scan line 15 on the N-th row drops to Vgc1 from Vgh, the voltage level of the first sub-pixel 41 will be modulated by the scan signal of the scan line 15 on the (N−1)-th row, while the voltage level of the second sub-pixel 45 will be modulated by the scan signal of the scan line 15 on the (N+1)-th row. The scan signals shown in FIG. 10 are also applied in the preferred embodiment of FIG. 8. The difference between the preferred embodiments of FIG. 10 and FIG. 9 is that the scan signals of the preferred embodiment of FIG. 10 have three voltage levels including Vgh, Vgc1, and Vgc2.

In the preferred embodiment shown in FIG. 8, the storage capacitor 47 of the second sub-pixel 45 can be coupled to the common electrode Vcom and not be modulated, while the storage capacitor 43 of the first sub-pixel 41 is still coupled to the scan line 15 on the previous row and is modulated. Alternatively, the storage capacitor 43 of the first sub-pixel 41 can be coupled to the common electrode Vcom and not be modulated, while the storage capacitor 47 of the second sub-pixel 45 is still coupled to the scan line 15 on the next row and is modulated. Besides, the storage capacitors 43, 47 of the first and second sub-pixels 41, 45 on the N-th row can be coupled to the scan lines 15 on the (N+1)-th and the (N+2)-th rows, respectively. Alternatively, the storage capacitors 43, 47 of the first and second sub-pixels 41, 45 on the N-th row can be coupled to the scan lines 15 on the (N−1)-th and the (N−2)-th rows, respectively.

Figure 11:
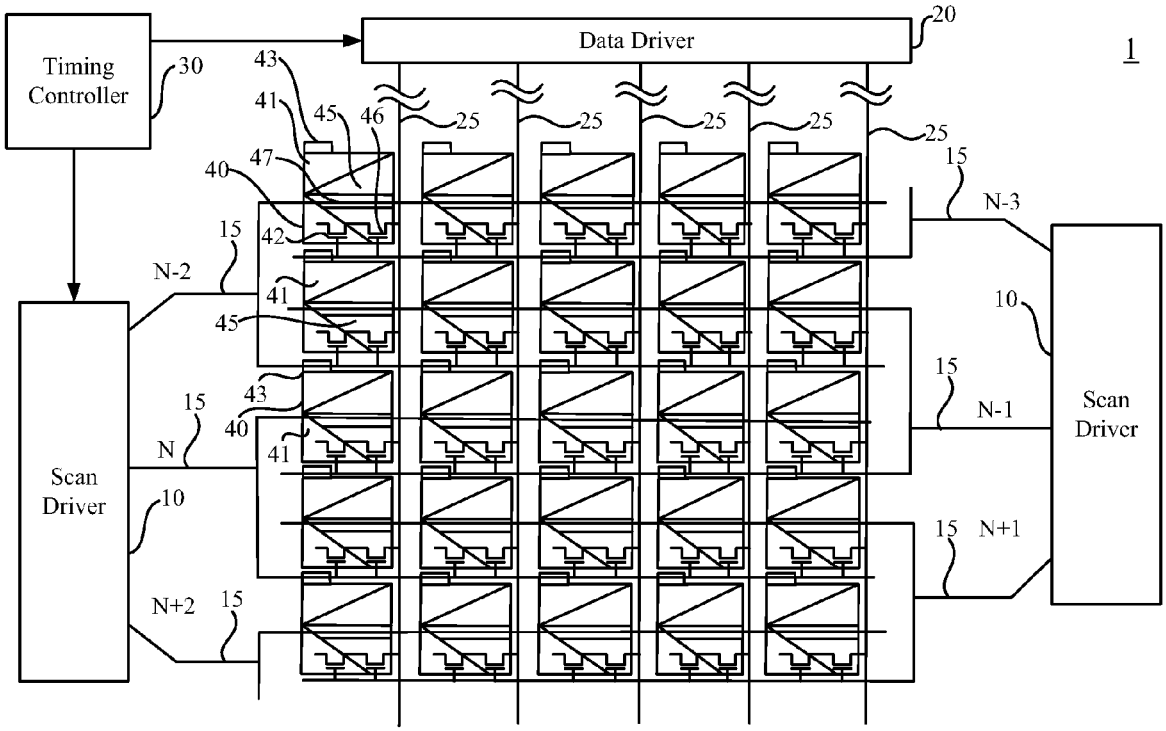
FIG. 11 shows a layout diagram according to a preferred embodiment of the present invention.

FIG. 11 shows a layout diagram according to the preferred embodiment of FIG. 8. In order to avoid crossing the scan line 15 on the same row when the storage capacitor 47 of the second sub-pixel 45 is coupled to the scan line 15 on the next row as shown in the circuit of FIG. 8, the pixel is designed to be "⊠"-shaped, where the first and the second sub-pixels 41, 45 are "◪"- and "◁"-shaped, respectively. The second sub-pixel 45 is coupled between the two triangles of the first sub-pixel 41 to form the "⊠" shape. The scan lines are designed to be "⊏"-shaped, and the scan lines on even rows and on odd rows are located on both sides of the LCD, respectively. Besides, the openings of the "⊏" shapes face to each other. Thereby, the bottom horizontal lines of the "⊏"-shaped scan lines 15 can be coupled to the lower part of the pixels 40, and be coupled to the switches 42, 46 of the first and second sub-pixels 41, 45, respectively. In addition, the bottom horizontal lines of the "⊏"-shaped scan lines 15 can cross the upper part of the pixel 40 on the next row, and be coupled to the storage capacitor 43 of the first sub-pixel 41 of the pixel 40. Moreover, the top horizontal lines of the "⊏"-shaped scan lines 15 can cross the center part of the pixel 40, and be coupled to the storage capacitor 47 of the second sub-pixel 45 of the pixel 40 on the previous row. By the description and figures above, it is known that such a layout design can make the storage capacitors 43, 47 of the sub-pixels 41, 45 of the pixel 40 be coupled to the scan lines on the previous and next rows, respectively, without crossing the scan lines 15 on the same row.

Figure 12:
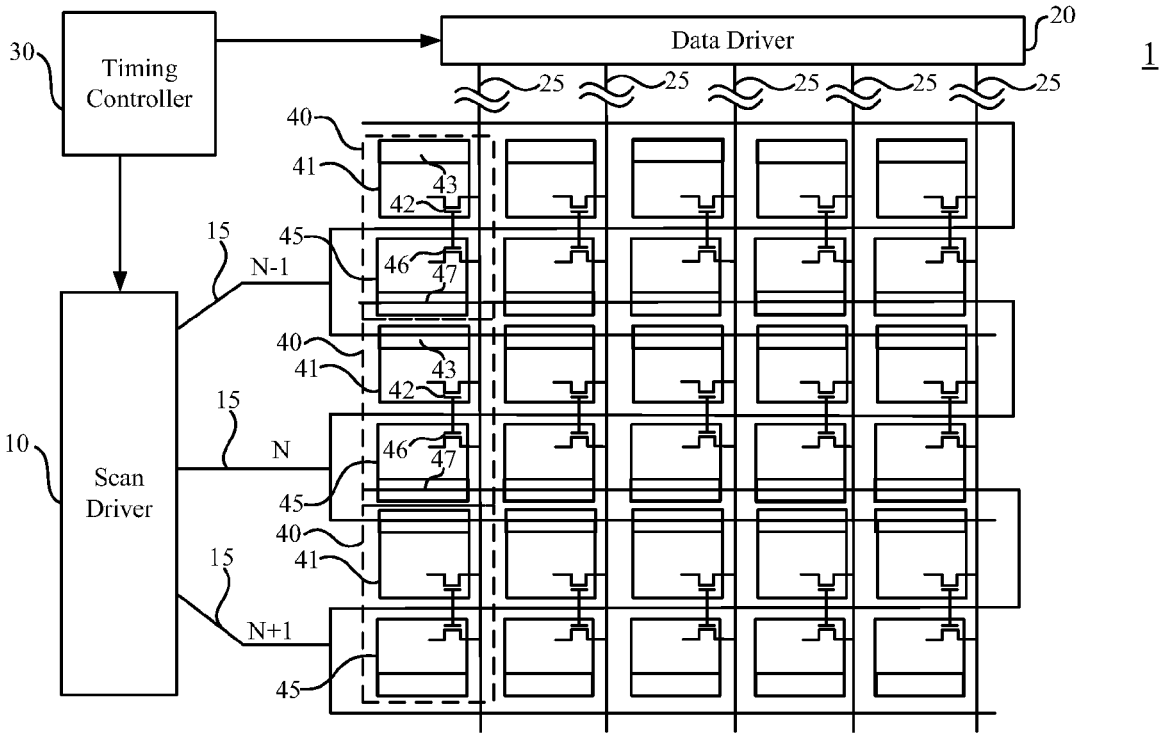
FIG. 12 shows another layout diagram according to another preferred embodiment of the present invention.

FIG. 12 shows another layout diagram applied in the preferred embodiment of FIG. 8. The switches 42, 46 of the sub-pixels 41, 45 according to the present preferred embodiment are coupled to the data line 25, and the formats of the sub-pixels 41, 45 and the scan lines 15 are different from the preferred embodiment of FIG. 11. According to the present preferred embodiment, the sub-pixels 41, 45 are rectangular, and the first and second sub-pixels 41, 45 are arranged up and down with the first sub-pixel 41 located on top of the second sub-pixel 45. In addition, the scan lines 15 are arranged zigzag in a "ㄹ" shape. The first sub-pixel 41 is located between the top and the center horizontal lines of the zigzag scan line 15, while the second sub-pixel 45 is located between the center and the bottom horizontal lines of the zigzag scan line 15. The switches 42, 46 of the first and second sub-pixels are coupled to the center horizontal line of the "ㄹ"-shaped scan line 15, and are coupled to the data line 25. Besides, the top horizontal line of the zigzag scan line 15 crosses the second sub-pixel 45 on the previous row, and is coupled to the storage capacitor 47, while the bottom horizontal line of the zigzag scan line 15 crosses the first sub-pixel 41 on the next row, and is coupled to the storage capacitor 43.

To sum up, according to the liquid crystal display and the driving method thereof of the present invention, each pixel is divided into a plurality of sub-pixels, and the storage capacitors of the sub-pixels of each pixel are coupled to the scan lines. Alternatively, the storage capacitor of one of the sub-pixels of each pixel is coupled to a common electrode, and the storage capacitors of the rest sub-pixels are coupled to the scan lines. The switch and the storage capacitor of each sub-pixel are coupled to different scan lines. In addition, with the scan signals having a plurality of voltage levels, the voltage levels of the sub-pixel electrodes of one or more sub-pixels of the pixels can be modulated, and thereby the sub-pixels in the same pixel can have different voltage levels. As a result, said sub-pixels can have different electric field strengths for driving the liquid crystals of said sub-pixels of each pixel to deflect at different angles, and hence, to have different transmission rates. Thereby, luminance and color distortion phenomena will be avoided while viewing the pictures of a liquid crystal display. Consequently, the displaying performance of the liquid crystal display is improved.

Accordingly, the present invention conforms to the legal requirements owing to its novelty, non-obviousness, and utility. However, the foregoing description is only a preferred embodiment of the present invention, not used to limit the scope and range of the present invention. Those equivalent changes or modifications made according to the shape, structure, feature, or spirit described in the claims of the present invention are included in the appended claims of the present invention.

What is claimed is:

1. A liquid crystal display, comprising:

a plurality of scan lines arranged in rows, the scan lines including a Nth scan line and N being a positive integer;

a plurality of data lines arranged in columns and crossing the scan lines;

a plurality of pixels corresponding to the scan lines, each pixel having a plurality of sub-pixels, each sub-pixel having a switch, a storage capacitor, and a sub-pixel electrode, the sub-pixel electrode being coupled electrically to the switch and the storage capacitor, the switches of the sub-pixels of each pixel being coupled to different scan lines, the switches on each row being coupled to one of the scan lines, one of the storage capacitors of the sub-pixels having a first terminal being coupled to one of the sub-pixel electrodes and a second terminal being directly coupled to one of the scan lines, the switch and the storage capacitor of each sub-pixel being directly coupled to different scan lines, and each sub-pixel being coupled to one of the data lines;

a data driver coupled electrically to the data lines, and transmitting data signals to the sub-pixels, respectively; and a scan driver, coupled electrically to the scan lines, and transmitting scan signals to the switches of the sub-pixels on each row, respectively, for turning the switches on for receiving the data signals;

wherein the sub-pixels include a first sub-pixel and a second sub-pixel, the two storage capacitors of the first sub-pixel and the second sub-pixel corresponding to the N-th scan line are coupled to the (N−1)-th scan line and the (N+1)-th scan line, respectively, the (N−1)-th scan line is coupled to the storage capacitor of one of the sub-pixels of each of the pixels corresponding to the N-th scan line, the (N−1)-th scan line is coupled to the storage capacitor of one of the sub-pixels of each of the pixels corresponding to the (N−2)-th scan line.

2. The liquid crystal display of claim 1, wherein the scan signals transmitted by the scan driver have a plurality of voltage levels for modulating voltage levels of one or more sub-pixel electrodes of the sub-pixels of the same pixel, and for enabling the sub-pixels of the same pixel to have different voltage levels.

3. The liquid crystal display of claim 1, wherein the (N−1)-th scan line crosses the pixel areas corresponding to the N-th scan line and to the (N−2)-th scan line, and is coupled to the storage capacitors of one of the sub-pixels of each of the pixels corresponding to the N-th and to the (N−2)-th scan lines.

4. The liquid crystal display of claim 1, wherein each pixel has a first sub-pixel and a second sub-pixel, the change of voltage levels of the storage capacitor of the first sub-pixel is greater than that of the second sub-pixel.

* * * * *